United States Patent [19]

Zahn et al.

[11] 4,046,614

[45] Sept. 6, 1977

[54] SPLICING APPARATUS FOR PHOTOGRAPHIC FILMS OR THE LIKE

[75] Inventors: Wolfgang Zahn, Munich; Helmut Zangenfeind, Puchheim; Günther Dömges Oberhaching, all of Germany

[73] Assignee: AGFA-Gevaert, Aktiengesellschaft, Leverkusen, Germany

[21] Appl. No.: 742,518

[22] Filed: Nov. 16, 1976

[30] Foreign Application Priority Data

Nov. 28, 1975 Germany ..... 2553611

[51] Int. Cl.[2] ..... B31F 5/00

[52] U.S. Cl. ..... 156/353; 156/378; 156/506

[58] Field of Search ..... 156/502, 505, 506, 507, 156/157-159, 353, 378; 242/58.5, 56.8

[56] References Cited

U.S. PATENT DOCUMENTS

| | | | |
|---|---|---|---|
| 3,516,890 | 6/1970 | Gallistel et al. | 156/505 |
| 3,687,751 | 8/1972 | Cumbo et al. | 156/64 |
| 3,779,837 | 12/1973 | Zahn et al. | 156/505 |

*Primary Examiner*—David A. Simmons
*Attorney, Agent, or Firm*—Peter K. Kontler

[57] ABSTRACT

Apparatus for splicing exposed photographic films to each other and to flexible threading tape has a housing defining a dark chamber, a splicer which is installed in the chamber, advancing rolls which transport the leaders of films and tape into the range of and beyond the splicer, a knife for the tape, and punches which apply holes into the tape ahead of and behind the knife. The holes which are punched into the leader of the remnant of severed tape are detected by a first photoelectric cell which is located ahead of the splicer whereby the cell arrests the advancing rolls for the tape to insure that the leader is located in an optimum position for splicing to the trailing end of the preceding film. The holes which are punched into the trailing ends of severed tape portions are detected by a second cell which is located behind the splicer and serves to arrest the advancing rolls for a severed tape portion so that its trailing end is held in an optimum position for splicing to the leader of a film. The cells also monitor the films which are formed with holes similar to those in the tape. When a web of end of the rearmost film, is to be removed from the apparatus, the attendant severs the tape in a region close to the outlet of the housing. The leader of the remnant of tape is held by a blocking device in an optimum position for attachment to the core of a fresh reel for one or more webs of spliced-together films.

14 Claims, 2 Drawing Figures

SPLICING APPARATUS FOR PHOTOGRAPHIC FILMS OR THE LIKE

BACKGROUND OF THE INVENTION

The present invention relates to apparatus for uniting webs of flexible material, especially for splicing photographic films to each other as well as to similar webs or strips. More particularly, the invention relates to apparatus for splicing photographic films to each other and/or to strips or webs (hereinafter called tapes) which are used to facilitate threading of films through various units in a photographic processing laboratory and/or to attach photographic films to the cores of reels or spools.

In order to enhance the output of modern photographic processing laboratories, it is customary to connect a large number of exposed photographic customer films end-to-end so that the films form a long web which is thereupon transported through the developing machine. As a rule, flexible tapes are connected to the leader as well as to the trailing end of each web. The front tape facilitates threading of the leader of the web through a developing or other machine in the processing laboratory and the attachment of the web to the core of a reel or spool. The purpose of the rear tape is to facilitate the attachment to the core of a reel on which the web is to be stored or to facilitate attachment of the web to the next web.

The output of the developing machine is increased if the web consists of a very large number of spliced-together exposed photographic films, i.e., if the number of interruptions which are necessary to thread the leader of a fresh web through the developing machine is reduced to a minimum. For example, a receptacle for storage of exposed but undeveloped photographic films can accommodate between 300 and 600 meters of film, i.e., at least 600–700 discrete films. On the other hand, the manipulation of extremely long webs of spliced-together photographic films in the copying machine, in the severing unit which subdivides the web into discrete films or into groups of film sections each belonging to a different customer, in the marking unit which provides the films with indicia in the form of notches, perforations or the like, and/or in the order center wherein the customer films and the associated prints are introduced into envelopes for shipment or to for pickup by customers or dealers adversely affects the output of such units. The optimum length of webs which are to be processed in various units following the developing machine is between 60 and 120 meters. Therefore, a long web which has been transported through the developing machine (e.g., a web having a length of 300–600 meters) is normally subdivided into shorter webs each of which has a length in the range of 60–120 meters. This entails the attachment of an additional tape to the trailing end of the foremost shorter web, to the leader of the rearmost shorter web as well to the leader and trailing end of the rearmost shorter web as well as to the leader and trailing end of each intermediate shorter web.

German Offenlegungsschrift No. 2,132,573 (See U.S. Pat. No. 3,779,837) discloses a splicing apparatus having means for supporting a reel of convoluted threading tape portions of which can be attached to the leaders and trailing ends of discrete webs each of which consists of several films spliced together end-to-end. It has been found that the manipulation of tape (especially proper positioning of its leader with respect to the trailing end of a web as well as proper positioning of the trailing end of a separated portion of tape relative to the leader of the next-following web) presents many problems, mainly because the tape does not exhibit perforations or other indicia which would allow for automatic stoppage of the leader of tape or the trailing end of a separated portion of tape in an optimum position relative to the trailing end or leader of a web of photographic films. In other words, it is difficult to properly position the leader of tape or the trailing end of a portion of tape at the splicing station where the tape is to be united with the trailing end or with the leader of a web. As a rule, proper positioning of tape involves placing the front edge face of the leader or the rear edge face of the trailing end at the center of the splicing station. If the leader and/or trailing end of the tape is not in an optimum position, the splice between the tape and the web is likely to be defective, i.e., the tape is likely to become separated from the web. This invariably entails lengthy interruptions in operation of the respective unit in the processing laboratory.

SUMMARY OF THE INVENTION

An object of the invention is to provide a novel and improved apparatus which is constructed and assembled in such a way that it can splice webs of photographic films to each other and/or to threading tapes with a degree of reliability and reproducibility which cannot be matched by conventional apparatus.

Another object of the invention is to provide an automatic splicing apparatus of the just outlined character which invariably insures that the leaders and/or trailing ends of webs of photographic films and threading tapes are caused to assume optimum positions at the splicing station.

A further object of the invention is to provide an apparatus which can be used with particular advantage to splice together a desired number of films in order to form an elongated web as well as to splice webs consisting of a large number of spliced-together exposed and developed films to threading tapes.

An additional object of the invention is to provide the apparatus with novel and improved means for treating threading tape prior and subsequent to splicing of tape to webs of photographic films.

An ancillary object of the invention is to provide a splicing apparatus which can be existing photographic processing laboratories as a superior substitute for conventional apparatus.

Still another object of the invention is to provide the apparatus with novel and improved means for guiding webs of photographic film and/or threading tape toward, through and beyond the splicing station.

The invention is embodied in an apparatus for uniting photographic films (especially exposed but undeveloped photographic films) with each other and/or with threading tape. The apparatus comprises a housing which defines a dark chamber and has at least one inlet and an outlet, a splicer which is installed in the chamber, guide means for directing the leaders of films and tape from the inlet into the range of the splicer, a reel or another source of tape which is located ahead of the splicer (preferably outside of the chamber), as considered in the direction of movement of tape into the range of the splicer, and means for treating the tape intermediate the source and the guide means. The treating means comprises means for severing the tape and means for applying to the tape indicia (e.g., holes) to facilitate the positioning of tape relative to the splicer. The treating means may but need not be located outside of the chamber and preferably defines an elongated path for movement of the tape from the source toward the guide means. The severing means is adjacent to a predetermined portion of such path and the indicia applying means preferably comprises first and second indicia applying members which are respectively located ahead of and behind the severing means, as considered in the direction of movement of tape along the path.

The apparatus further comprises means for advancing the films and tape in the chamber toward and beyond the splicer and means for monitoring the indicia on the tape. Such monitoring means preferably includes a first signal generating scanning device (e.g., a photoelectric cell) located ahead of the splicer and a second signal generating scanning device located behind the splicer. The apparatus also comprises means for arresting the advancing means in response to signals from the scanning devices. The first and second scanning devices are respectively responsive to detection of indicia applied by the first and second indicia applying members. The distances between the first and second indicia applying members and the severing means respectively equal or closely approximate the distances between the first and second scanning devices and the splicer.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
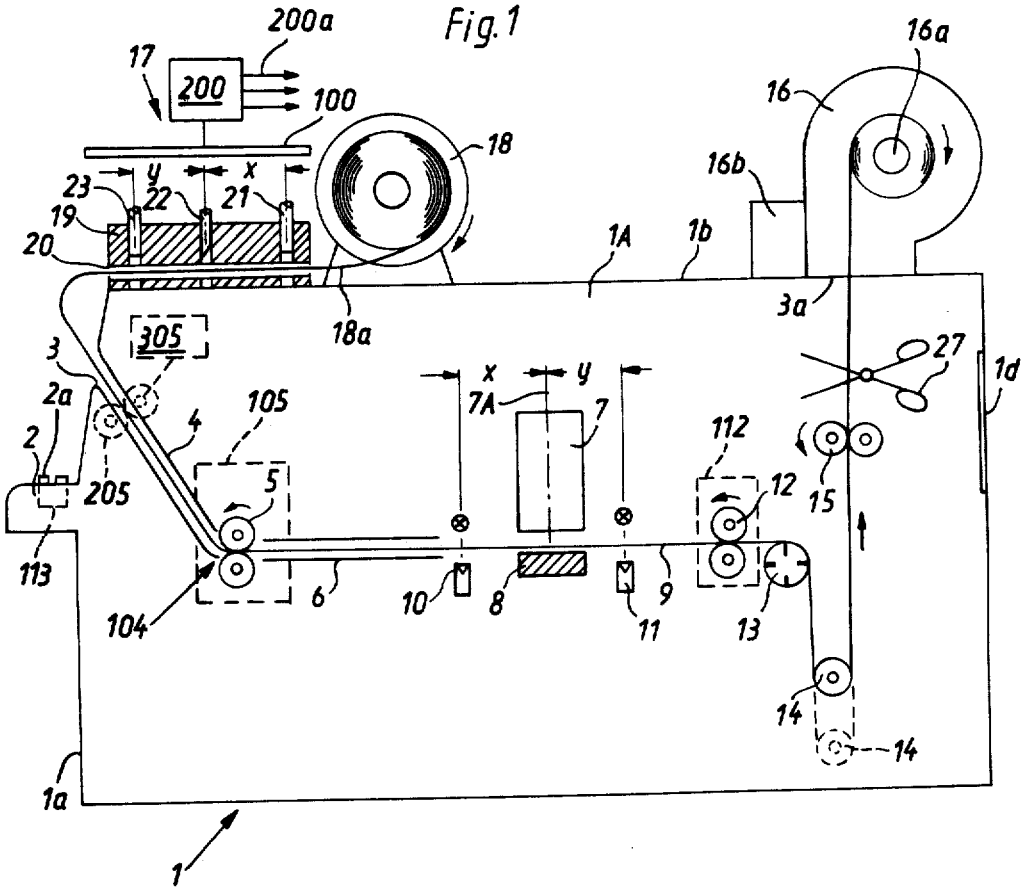
FIG. 1 is a schematic partly elevational and partly vertical sectional view of a splicing apparatus which embodies the invention.
Figure 2:
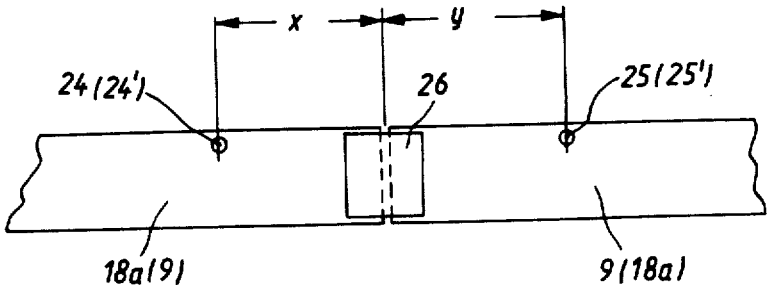
FIG. 2 is a plan view of a splice between a photographic film and threading tape.

Referring to FIG. 1, the apparatus comprises a housing 1 which defines a dark chamber 1A for a splicer 7 including a support or anvil 8 on which photographic films 9 or photographic films and tape 18*a* can be spliced together in a manner shown in FIG. 2. The front wall 1*a* of the housing 1 carries a control panel 2 with push-buttons or other types of actuating elements 2*a* which can be depressed by an attendant to initiate or terminate certain operations of the splicing apparatus. The front wall 1*a* of the housing 1 is further provided with a slot-shaped inlet 3 for introduction of the leaders of successive films 9 or for introduction of the leader of tape 18*a*. The housing 1 contains means to guide films and tape from the inlet 3 into the range of the splicer 7 as well as beyond the splicer and toward and through an outlet 3*a* which is disposed below the inlet end of a receptacle or cassette 16 for storage and coiling of films and tape therein. The receptacle 16 preferably contains a reel or spool 16*a* whose core is driven by a motor 16*b* so that it rotates in the direction indicated by the arrow. The apparatus comprises suitable means (not specifically shown) for sealingly but detachably securing the receptacle 16 to the top wall 1*b* of the housing 1 so that the outlet 3*a* and the inlet end of the receptacle are sealed against entry of light.

The inlet 3 receives those exposed but undeveloped films 9 which cannot be readily removed from their cassettes by resorting to an automatic removing apparatus, for example, an apparatus of the type disclosed in commonly owned U.S. Pat. No. 3,921,878 granted Nov. 25, 1975 to Zangenfeind or in commonly owned copending application Ser. No. 652,107 filed Jan. 26, 1976, now U.S. Pat. No. 4,004,724, by Zangenfeind et al. Films which cannot be expelled by the just mentioned apparatus must be removed upon opening (which normally involves at least partial destruction) of their cassettes. The area around the housing 1 is then converted into a dark chamber to prevent destruction of images on the exposed but still undeveloped frames of such films. A film cannot be readily removed from its cassette if the trailing end of the backing strip for the film is completely separated from the corresponding reel or spool in the interior of the cassette. Devices which can be used for opening of cassettes in order to gain access to takeup reels for exposed films or at least to the trailing ends of exposed films are well known in the art.

The aforementioned means to guide the films 9 and tape 18*a* intermediate the inlet 3 and outlet 3*a* of the housing 1 comprises a first guide member 4 which is located immediately downstream of the inlet 3 and terminates at the nip of two advancing rolls 5. These rolls feed the film or tape into a second guide member 6 which terminates upstream of the splicer 7. The film or tape thereupon advances into the nip of second advancing rolls 12 which are mounted in the housing 1 ahead of a rotary length measuring device 13. The film or tape thereupon travels around a dancer roll 14 which loops the film or tape ahead of a blocking device 15 serving to prevent rearward movement of the film or tape intermediate the splicer 7 and outlet 3*a*, e.g., in response to the bias of dancer roll 14. The blocking device 15 may include two rollers one of which is provided with a one-way clutch permitting the respective roller to rotate in a direction to advance the film or tape toward the outlet 3*a* but preventing the flexible material from moving downwardly, as viewed in FIG. 1.

The housing 1 preferably further contains a device of the type disclosed in commonly owned copending application Ser. No. 729,700 filed Oct. 5, 1976 by Hujer et al. This application discloses that a portion of the path for films 9 which cannot be automatically removed from their cassettes coincides with a portion of the path for films which are removed automatically, e.g., by resorting to the apparatus which are disclosed in the aforediscussed U.S. Pat. No. 3,921,878 and in the application Ser. No. 652,107, now U.S. Pat. No. 4,004,724. The separate portion of the path for automatically removed films terminates at the nip of the advancing rolls 5 (the arrow 104 indicates the direction in which such films can be fed into the nip of the rolls 5 for transport toward the splicer 7).

The housing 1 further accommodates a first scanning device 10 (e.g., a photoelectric cell) which monitors the leaders of films 9 for the presence of holes or other indicia. Such indicia are applied to films prior to introduction into the guide member 4. In accordance with a feature of the invention, the tape 18*a* is also provided with indicia which can be detected by the cell 10. A second scanning device 11 (preferably a photoelectric cell) is mounted in the housing 1 downstream of the splicer 7 to detect indicia (preferably holes or perforations) which are applied to the trailing ends of films 9 and to the trailing end of a severed portion of tape 18*a*.

The distance $x$ between the center (denoted by the phantom line 7A) of the splicer 7 and the cell 10 may but need not equal the distance $y$ between the line 7A and the cell 11.

The apparatus of FIG. 1 further comprises a treating unit 17 which can be mounted in or on the housing 1. In the embodiment of FIG. 1, the unit 17 is mounted on the top wall 1*b* close to the control panel 2 and inlet 3. The dimensions of the unit 17 (with respect to dimensions of other parts of the apparatus) are exaggerated for the sake of clarity. The unit 17 comprises a block-shaped support 19 which has a horizontal channel 20 defining an elongated path for movement of the tape 18*a* from a source 18 toward the inlet 3. The source 18 is a reel or spool which stores a substantial quantity of convoluted tape upstream of the inlet of the channel 20. The block 19 further supports two indicia applying members in the form of reciprocable punches 21, 23 and a reciprocable knife 22 which is disposed between the punches 21, 23 and serves to sever the tape 18*a* in the channel 20. The distance between the cutting edge of the knife 22 and the first (right-hand) punch 21 equals $x$, and the distance between such cutting edge and the punch 23 equals $y$. The parts 21, 22, 23 can be actuated by hand, e.g., through the medium of a manually depressible pusher 100, or automatically in response to a signal which initiates a downward movement of the pusher 100. The latter may constitute the reciprocable armature of an electromagnet 200 which is energizable to actuate the parts 21–23. Suitable springs or other biasing means are provided to automatically lift the parts 21–23 as soon as they complete a working stroke. One side of the channel 20 is preferably open so that the leader of a fresh roll of tape 18*a* can be readily threaded through the block 19. The directions in which the parts 21–23 are reciprocable are preferably normal to the plane of the tape in the channel 19 and to the direction of forward movement of tape from the reel 18 toward the inlet 3.

The operative connections between the automatic actuating means 200 for the parts 21–23 of the treating unit 17 and the motors 105, 112 for advancing rolls 5, 12, the motor 16*b* for the reel 16*a* and the splicer 7 are indicated by arrows 200*a*.

The operation:

When the apparatus is idle, or when the inlet 3 receives a succession of films 9, the front edge of the leader of tape 18*a* is located in the plane of the cutting edge of the knife 22 in the treating unit 17. The trailing end of each film 9 is provided with an indicium 25 (preferably a hole shown in FIG. 2) which is detected by the cell 11 whereby the latter arrests the motor 112 for the advancing rolls 12 and the motor 16*b* so that the rear edge of such film comes to a halt at or very close to the center (plane 7A) of the splicer 7 (i.e., it rests on the anvil 8). Analogously, the leader of each film 9 is provided with an indicium 24′ (e.g., a hole shown in FIG. 2) which is detected by the cell 10 whereby the latter transmits a signal which arrests the motor 105 for the advancing rolls 5 in such position that the front edge of the leader is flush with or very close to the center of the splicer 7 and rests on the anvil 8. The cell 10 further transmits a signal to the splicer 7 which unites the trailing end of the preceding film 9 with the leader of the next-following film 9, preferably by resorting to a heat-sealable uniting band 26 (shown in FIG. 2). When the splicing operation is completed, the splicer 7 transmits a signal which is used to start the motors 105, 112 and the motor 16*b* for the reel 16*a* so that the spliced-together films 9 advance toward and are collected on the core of the reel 16*a* in the receptacle 16. The motors 112 and 16*b* are arrested by the cell 11 when the latter detects the indicium 25 in the trailing end of the last film 9. The motor 105 is on and advances the leader of the next film 9 (which has been introduced into the guide member 4 via inlet 3) toward the splicer 7 whereby the film is automatically arrested as soon as the cell 10 detects the indicium 24′ in its leader. The same procedure is repeated again and again until the receptacle 16 accumulates a web consisting of spliced-together films 9. As mentioned above, the length of a web is normally between 60 and 120 meters.

The attendant can count the number of films 9 which form the web on the core of the reel 16*a*, or the attendant can inspect a suitable counter on the control panel 2 which records the number of inserted films. The attendant than arrests the motors 105, 112, 16*b* and splicer 7 and pushes or pulls the leader of tape 18*a* toward the inlet 3 (as mentioned above, the front edge of the leader of tape 18*a* is normally in line with the cutting edge of the knife 22, and the leader of the tape has an indicium (e.g., a hole 24 shown in FIG. 2) which has been formed by the punch 21 in response to last depression of the pusher 100. The leader of tape 18*a* is advanced beyond the channel 20 to be introduced into the inlet 3 and toward the nip of the advancing rolls 5. The housing 1 preferably contains a pair of auxiliary driven rolls 205 (indicated by broken lines) which are closely adjacent the inlet 3 and can be driven by a motor 305 in response to depression of a knob on the control panel 2. The rolls 205 immediately engage and advance the leader of the tape 18*a*, and the starting of motor 305 preferably entails starting of the motor 105 so that the leader of tape is engaged and advanced by the rolls 5 as soon as it reaches the lower end of the guide member 4. It is preferred to drive the auxiliary rolls 205 at a speed which is at least slightly less than the peripheral speed of the rolls 5 and to provide the rolls 205 with overrunning clutches. This insures that the rolls 205 do not oppose forward movement of the tape 18*a* when the latter reaches the advancing rolls 5. Reference may be had to the aforementioned commonly owned copending application Ser. No. 729,700 of Hujer et al. which discloses two pairs of rolls driven at different peripheral speeds for the same purpose as explained above in connection with the advancing rolls 5 and 205.

If desired, the apparatus can be equipped with automatic advancing means which is started in response to a signal from the control panel 2 and serves to introduce the leader of tape 18*a* into the guide member 4 and thereupon into the range of advancing rolls 5 and/or 205. The provision of auxiliary rolls 205 is optional but desirable because they insure that the advancement of leader of the tape 18*a* into the range of the rolls 5 takes up a short interval of time. The same holds true for the aforementioned automatic means which can be used to move the leader of tape 18*a* from the severing station (knife 22) into the inlet 3 and into the range of advancing rolls 205 or 5.

The indicium 24 which has been applied to the leader of the tape 18*a* by punch 21 is detected by the cell 10 when the front edge of tape reaches or is very close to the center of the splicer 7. The cell 10 immediately arrests the motors 105 and 305 (the latter can be arrested in automatic response to advancement of the leader of tape into the range of the rolls 5 or into the left-hand portion of the guide member 6) so that the tape comes to a halt in an optimum position for splicing of its leader to the trailing end of the last film 9 of the web which is already stored in the receptacle 16. The indicium 25 in the trailing portion of such film 9 is in register with the cell 11. It will be recalled that the motor 112 for the advancing rolls 12 is arrested in automatic response to detection of the indicium 25 by the cell 11 so that the rear edge of the trailing portion of the film of a web is located in line with or very close to the center of the splicer 7. The cell 10 transmits a signal which starts the splicer 7 so that the latter attaches the trailing end of the last film 9 to the leader of the tape 18*a* by means of a uniting band 26.

It is clear that the heat-sealable uniting band 26 represents but one of various means which can be used for the splicing of films 9 to each other and/or for splicing of films to the tape 18*a*. For example, the splicer 7 can be designed to roll a splice while the trailing end of a film 9 overlaps the leader of the tape (or vice versa) or while the trailing end of the tape overlaps the leader of a film (or vice versa). Alternatively, the uniting band can be coated with a suitable adhesive.

When the trailing end of the film 9 is spliced to the leader of the tape 18*a*, the splicer 7 transmits a signal which starts the motor 112 for the advancing rolls 12 and the motor 16*b* for the reel 16*a*. Thus, the leader of tape 18*a* moves between the advancing rolls 12, along the measuring device 13, around the dancer roll 14, through the nip of rollers constituting the blocking device 15, and into the interior of the receptacle 16. The rotating measuring device 13 actuates a counter which is mounted in the control panel 2 and is observed by the attendant. It is also within the purview of the invention to connect the measuring device 13 with an adjustable arresting unit 113 for the motor 112 so that the latter is arrested as soon as a predetermined length of tape 18*a* advances beyond the measuring device 13; this is often desirable because the task of the attendant is simplified by eliminating the need for continuous monitoring of the length of tape which has been advanced beyond the measuring device 13. Stoppage of the motor 112 preferably entails simultaneous stoppage of the motor 16*b*.

When the advancing rolls 12 are again at a standstill, the attendant depresses (or causes the depression of) the pusher 100 so that the knife 22 severs the tape 18*a* and the punches 21, 23 respectively form holes 24, 25' in the fresh leader of tape 18*a* and in the trailing end of the freshly separated portion of tape (i.e., in the trailing end of that portion whose leader is located in the interior of the receptacle 16). If the pusher 100 is actuated automatically, the means 200 for moving this pusher downwardly, as viewed in FIG. 1, can receive a signal from the splicer 7. It should be noted that the pusher 100 is depressed only if the tape portion which extends from the severing station of the treating unit 17 into the interior of the receptacle 16 is to be used as a connector or coupling between two spaced-apart films 9, i.e., if the tape is to connect a preceding web (which consists of a series of spliced-together films) to the next-following web.

If the tape portion in the housing 1 should not constitute an appendage to the last film of a web of spliced-together films, the pusher 100 is depressed so that the knife 22 severs the tape and the punches 21, 23 provide the adjacent tape portions with holes 24, 25' or analogous indicia. The pusher 100 or the actuating means 200 can start the motors 112 and 16*b* as soon as the pusher reassumes the inoperative position of FIG. 1 (alternatively, the motors 112, 16*b* can be started by the attendant who depresses a pushbutton on the control panel 2) whereby the severed portion of tape 18*a* advances toward and into the receptacle 16. Such portion of the tape is arrested as soon as the indicium 25' which has been formed by the punch 23 in its trailing end reaches the cell 11. The rear edge of the trailing end of the tape portion is then in line with the center of the splicer 7. The attendant introduces the leader of the foremost film 9 of the next web, and such leader is automatically arrested when the indicium 24' therein is detected by the cell 10. The leader of the fresh film 9 is then spliced to the trailing end of tape portion which extends from the line 7A toward and into the receptacle 16, the splicer 7 starts the motor 112 to advance the remnant of tape portion and the leader of the fresh film into the receptacle 16, and so on. The same procedure is repeated again when the next web is completed, whereupon the attendant introduces the leader of tape 18*a* into the inlet 3 and into the range of advancing rolls 205.

If the tape which has been attached to the last film of a web is to constitute an appendage of such web, the attendant proceeds as follows: The pusher 100 is not depressed; instead, the motor 112 is started so that the rolls 12 advance a selected length of tape 18*a* into the receptacle 16. As mentioned above, this length can be determined by the attendant who observes the counter on the control panel 2 or by the automatic arresting device 113 which is connected to the measuring device 13 and arrests the motors 112, 16*b* when the receptacle 16 contains a desired length of tape. The attendant then opens a door 1*d* of the housing 1 to gain access to a second severing device (here shown as a shears 27) which is actuated to sever the tape in a region below the outlet 3*a*. This renders it possible to detach the filled receptacle 16 from the housing 1 for transfer into the next station of the processing laboratory, e.g., into a copying machine or into a prereader which precedes or is built into the copying machine. It is clear that the shears 27 or another suitable severing device can be actuated in response to transmission of a suitable signal from the control panel 2, i.e., the door 1*d* is optional.

The blocking device 15 prevents the leader of the remnant of tape 18*a* from moving backwards under the action of the roll 14. This is desirable because such leader must be attached to the core of the reel 16*a* which is confined in a fresh receptacle 16. The fresh receptacle 16 is attached to the top wall 1*b* so that it seals the outlet 3*a* (with the leader of the tape 18*a* already attached to the core of the reel 16*a* in such receptacle). The attachment of the leader of tape to the core of a reel 16*a* preferably precedes the attachment of corresponding receptacle 16 to the top wall 1*b*. This enables the attendant to push or pull the leader of tape 18*a* upwardly through the outlet 3*a* whereby the blocking device 15 does not interfere with forward movement of the tape. The door 1*d* is then closed, the new receptacle 16 is attached to the housing 1, and the attendant starts the motors 112 and 16*b*, i.e., the tape 18*a* advances toward and into the receptacle until the core of the reel 16*a* accumulates a desired length of tape. The attendant than actuates (or causes actuation of) the pusher 100 so that the knife 22 severs the tape and the punches 21, 23 respectively form indicia 24, 25' in the fresh leader of tape 18*a* and in the trailing end of the severed portion of the tape. The severed portion of tape comes to a halt as soon as the indicium 25' therein (formed by the punch 23) is detected by the cell 11. The apparatus is then ready to receive the foremost film 9 of a series of films which are to be spliced to each other in order to form a web. The cell 10 arrests the leader of the foremost film 9 in an optimum position for splicing to the trailing end of tape which is attached to the core of the fresh reel 16*a*, and the splicer 7 thereupon applies a uniting band 26 to connect the tape with the film. From then on, the operation of the apparatus is the same as described above.

If desired, the pusher 100 can be depressed as soon as the leader of tape 18*a* is attached to the core of a fresh reel 16*a*; this depends upon whether the attendant wishes the receptacle 16 to contain a relatively short or a longer portion of tape in immediate proximity to the core.

The front edge face of the leader of the remnant of tape 18*a* remains in register with the edge of the knife 22 until the fresh reel 16*a* accumulates a complete web of spliced-together films 9. The leader of tape 18*a* is then advanced toward the splicer 7 to be attached to the trailing end of the last film 9 of the freshly collected web.

Referring again to FIG. 2, it will be noted that the rear edge face of the trailing end of the preceding flexible element (which may be a film 9 or a tape 18*a*) need not abut against the front edge face of the leader of the next-following flexible element (which may be the tape 18*a* or a film 9). FIG. 2 further shows that the distance between the center of the splicer 7 and the indicium 25 or 25' (in the trailing end of the film 9 or tape 18*a*) equals $y$ which is the same as the distance between the cutting edge of the knife 22 and the center of punch 23, and that the distance $x$ between the center of the splicer and the indicium 24 or 24' (in the leader of the tape 18*a* or a film 9) equals the distance between the cutting edge of the knife 22 and the center of the punch 21. If the uniting band 26 of FIG. 2 is still located at the splicing station, the indicium 25 or 25' is in register with the cell 11 and the indicium 24 or 24' is in register with the cell 10.

The improved apparatus exhibits several important advantages. Thus, when a freshly loaded receptacle 16 is detached from the housing 1, the leader of the remnant of tape 18*a* remains very close to the outlet 3*a* so that the leader can be readily reached and attached to the core of a fresh reel 16*a*. This is in contrast to the mode of operation of conventional apparatus wherein the leader of the remnant of tape must be threaded through the entire apparatus whenever the tape is severed in order to allow for detachment of a freshly filled receptacle.

Another important advantage of the apparatus is that it is equipped with means (punches 21, 23 or analogous indicia applying members) which can provide indicia in the trailing end of the severed portion of tape as well as in the leader of the remnant of tape. This enables the apparatus to automatically advance the trailing end of the severed portion of tape to an optimum position relative to the splicer 7 as well as to advance the leader of the remnant of tape to an optimum position with respect to the splicer and with respect to the trailing end of the last film of a web. In other words, the provision of punches 21, 23 renders it possible to effect reproducible and accurate positioning of trailing ends and leaders of tape for splicing to preceding or next-following films, depending upon whether the tape is to be used as a forward extension of a web (i.e., as a means for attaching the foremost film of a web to the core of the respective supply reel) or as a connector or coupling between two successive webs, or whether the tape is to be used as an appendage at the trailing end of a complete web or a series of successive webs in a given receptacle 16.

A further important advantage of the improved apparatus is that the scanning devices (cells 10 and 11) which monitor indicia in the leaders and trailing ends of films 9 can also serve as a means for detecting indicia in the trailing ends and leaders of tape. This contributes to simplification, greater reliability and lower cost of the apparatus.

Still another advantage of the apparatus is that it can be used to splice together successive films, to splice the leader of a film to the trailing end of tape, to splice the trailing end of a film to the leader of tape, or to properly connect two spaced-apart films 9 by means of a selected length of tape. The insertion of one or more tape portions between successive webs of a composite web takes up little time. Such tape portions are thereupon severed before the films are introduced into a copying machine or into any other unit of the processing laboratory which operates more satisfactorily while processing relatively short webs of photographic films. Whenever a tape between two webs is severed, it is preferably cut midway between the preceding and next-following films so that the tape which follows a film can be used for convenient attachment (if necessary) to the tape at the front end of the next web, or that the tape at the front end of a web can be used as a means for conveniently threading the respective web through a selected unit in the processing laboratory. Since the length of tape portions between two webs can be selected practically at will (either by resorting to an adjustable device or by observing a counter on the control panel), the length of aforediscussed portions of severed tape between the successive webs can be readily chosen to insure maximum convenience and minimal loss in time during handling of separated webs.

If desired, the tape at the forward or rear end of a web can be used to store information in the form of handwritten data, in encoded form or both. If the tape is to carry additional information (i.e., information in addition to indicia which are applied by the punches 21, 23 or the like), the treating unit 17 is preferably mounted outside of the chamber 1*a* so that the tape 18*a* is readily accessible for the application of additional information. Also, the punches 21, 23 can be replaced with means for applying indicia in the form of labels or patches which are coated with adhesive so that they can readily adhere to selected portions of the tape. Such labels are then detected by the cell 10 or 11 or by other suitable scanning devices in the housing 1. Furthermore, the indicia may be applied by hand (e.g., by resorting to a pencil or pen), as long as they can be readily detected by the cells 10, 11 or analogous scanning devices. In other words, the indicia applying means in the form of punches 21, 23 are optional because the indicia can also assume forms which do not necessitate removal of any material from the tape (on the contrary, indicia may constitute printed, handwritten or other matter which is applied to one or both sides of selected portions of tape).

Without further analysis, the foregoing will so full reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. Apparatus for uniting photographic films with each other and/or with threading tape, comprising a housing defining a dark chamber; a splicer installed in said chamber; guide means for directing the leaders of films and tape into the range of said splicer; a source of tape located ahead of said guide means, as considered in the direction of movement of tape into the range of said splicer; and means for treating the tape intermediate said source and said guide means, said treating means comprising means for severing the tape and means for applying indicia which facilitate the positioning of tape relative to said splicer.

2. Apparatus as defined in claim 1, wherein said source and said treating means are located outside of said chamber.

3. Apparatus as defined in claim 1, wherein said treating means defines an elongated path for movement of tape from said source toward said guide means, said severing means being adjacent a predetermined portion of said path and said indicia applying means comprising first and second indicia applying members respectively located ahead of and behind said severing means, as considered in the direction of movement of tape along said path.

4. Apparatus as defined in claim 3, wherein each of said members includes means for removing material from the tape in said path.

5. Apparatus as defined in claim 3, further comprising means for advancing the films and tape in said guide means toward and beyond said splicer, means for monitoring the indicia on the tape, said monitoring means including a first signal generating scanning device located ahead of said splicer and a second signal generating scanning device located behind said splicer, and means for arresting said advancing means in response to signals from said scanning devices, said first and second scanning devices being respectively responsive to detection of indicia applied by said first and second members.

6. Apparatus as defined in claim 5, wherein the distances between said first and second indicia applying members and said severing means respectively equal the distances between said first and second scanning devices and said splicer.

7. Apparatus as defined in claim 3, further comprising means for simultaneously actuating said severing means and said indicia applying members.

8. Apparatus as defined in claim 7, wherein said treating means comprises a common support for said severing means and said indicia applying members.

9. Apparatus as defined in claim 3, further comprising means for advancing the films and tape in said guide means toward and beyond said splicer, means for monitoring the indicia on the tape including first and second signal generating scanning devices respectively located ahead of and behind said splicer and respectively responsive to detection of indicia applied by said first and second members, means for actuating said severing means and said members, means for measuring the length of tape which advances beyond said splicer, and operative connections between said actuating means on the one hand and said advancing, monitoring and measuring means and said splicer on the other hand.

10. Apparatus as defined in claim 9, further comprising means for arresting said advancing means in response to detection of a predetermined length of tape by said measuring means.

11. Apparatus as defined in claim 10, further comprising a control panel and means for adjusting said arresting means, said adjusting means being accessible at said control panel.

12. Apparatus as defined in claim 1, wherein said housing has an inlet for introduction of tape and said guide means includes a portion which is closely adjacent to said inlet.

13. Apparatus as defined in claim 1, wherein said housing has at least one inlet for admission of films and tape into said guide means and one outlet for films and tape downstream of said splicer, as considered in the direction of movement of films and tape toward, through and beyond said splicer, and further comprising lightproof means for receiving films and tape issuing from said housing by way of said outlet and means for blocking the movement of films and tape counter to said direction intermediate said outlet and said splicer.

14. Apparatus as defined in claim 13, wherein said receiving means comprises a driven take-up reel.

* * * * *